US007169216B2

(12) United States Patent
Itabashi et al.

(10) Patent No.: US 7,169,216 B2
(45) Date of Patent: Jan. 30, 2007

(54) ELECTROLESS COPPER PLATING SOLUTION, ELECTROLESS COPPER PLATING PROCESS AND PRODUCTION PROCESS OF CIRCUIT BOARD

(75) Inventors: Takeyuki Itabashi, Hitachi (JP); Hiroshi Kanemoto, Hitachi (JP); Haruo Akahoshi, Hitachi (JP); Eiji Takai, Yokohama (JP); Naoki Nishimura, Yokohama (JP); Tadashi Iida, Atsugi (JP); Yoshinori Ueda, Yasucho (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/898,282

(22) Filed: Jul. 26, 2004

(65) Prior Publication Data

US 2005/0079280 A1 Apr. 14, 2005

Related U.S. Application Data

(63) Continuation of application No. 10/076,536, filed on Feb. 19, 2002, now Pat. No. 6,805,915.

(30) Foreign Application Priority Data

Feb. 23, 2001 (JP) ..... 2001-048685

(51) Int. Cl.
*C23C 18/40* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS 4,118,234 A * 10/1978 Jans ..... 106/1.23
4,303,443 A * 12/1981 Miyazawa et al. ..... 106/1.23
4,617,205 A 10/1986 Darken
6,645,557 B2 * 11/2003 Joshi ..... 427/304
6,660,071 B2 * 12/2003 Yoshida et al. ..... 106/1.23
6,805,915 B2 * 10/2004 Itabashi et al. ..... 427/437
2002/0064592 A1 5/2002 Datta et al.

FOREIGN PATENT DOCUMENTS

JP 61-183474 10/1986
JP 7-268638 10/1995
JP 2000-144438 5/2000

OTHER PUBLICATIONS

"Electroless Copper Plating Using Glyoxylic Acid as a Reducing Agent," Surface Technology, vol. 42, No. 9, pp. 913-917 (1991), no month available.
The 6th national convention record of Japan institute of Printed Circuit, pp. 101-102, no date available.

* cited by examiner

*Primary Examiner*—Helene Klemanski
(74) *Attorney, Agent, or Firm*—Dickstein Shapiro LLP

(57) ABSTRACT

An electroless copper plating solution using glyoxylic acid as a reducing agent, which is small in the reacting quantity of Cannizzaro reaction, does not largely cause precipitation of the salt accumulated in the electroless copper plating solution by the plating reaction and Cannizzaro reaction, and can be used stably over a long period of time. The electroless copper plating solution comprises copper ion, a complexing agent for copper ion, a reducing agent for copper ion and a pH adjusting agent, wherein the reducing agent for copper ion is glyoxylic acid or a salt thereof, the pH adjusting agent is potassium hydroxide and the electroless copper plating solution contains at least one member selected from metasilicic acid, metasilicic acid salt, germanium dioxide, germanic acid salt, phosphoric acid, phosphoric acid salt, vanadic acid, vanadic acid salt, stannic acid and stannic acid salt in an amount of 0.0001 mol/L or more.

3 Claims, No Drawings

ELECTROLESS COPPER PLATING SOLUTION, ELECTROLESS COPPER PLATING PROCESS AND PRODUCTION PROCESS OF CIRCUIT BOARD

CROSS-REFERNCE TO RELATED APPLICATION

The present application is a continuation application of U.S. Pat. application Ser. No. 10/076,536, filed on Feb. 19, 2002, now U.S. Patent. No. 6,805,915, the disclosure of which is incorporated herein by reference.

FIELD OF THE INVENTION

This invention relates to an electroless copper plating solution mainly used for a formation of circuits in electronic parts, an electroless copper plating process and process for producing a circuit board each using said electroless copper plating solution; and particularly to a plating solution and plating technique each using glyoxylic acid but not using formaldehyde having a high volatility as a reducing agent for copper ion.

BACKGROUND OF THE INVENTION

In JP-A-7-268638, there is proposed a plating process which comprises carrying out a plating while filtering a plating solution with the aim of preventing a body to be plated from a deposition of sodium oxalate precipitate formed in an electroless copper plating solution.

In JP-A-61-183474, there is mentioned a technique of using glyoxylic acid as a reducing agent in electroless copper plating solution. In this document, it is mentioned that NaOH or KOH is used for alkalifying the pH of electroless copper plating solution, and especially that KOH is more desirable than NaOH because potassium oxalate is higher than sodium oxalate in solubility of an oxalate salt which is an oxidized product of glyoxylic acid.

SUMMARY OF THE INVENTION

An electroless copper plating solution usually comprises copper ion, a complexing agent for copper ion, a reducing agent for copper ion and a pH adjusting agent.

As the reducing agent for copper ion, formaldehyde, glyoxylic acid or a salt of glyoxylic acid has been used generally. In plating solutions, an ion of oxidized product of reducing agent accumulates. In the case of using formaldehyde as a reducing agent for copper ion, the accumulating substance is formate ion. In the case of using glyoxylic acid as the reducing agent, the accumulating substance is oxalate ion.

On the other hand, as the pH adjusting agent in electroless copper plating solutions, NaOH has been generally used.

When NaOH was used as a pH adjusting agent and glyoxylic acid was used as a reducing gent, there has arised a difficulty that sodium oxalate is so small in solubility that precipitate of sodium oxalate was formed in the plating solution in the way of plating process. If such a solid precipitate is deposited on a body to be plated, no plating film can be formed in the area to which the precipitate is attached, and there is formed the so-called "void".

In the case of using glyoxylic acid, the accumulation of oxalic acid in a plating solution is caused not only by the plating reaction but also by the Cannizzaro reaction. In the case of using glyoxylic acid, the Cannizzaro reaction is expressed by the following scheme:

$$2CHOCOOH+2OH^- \rightarrow C_2O_4^{2-}+HOCH_2COOH+H_2O$$

Since reaction rate of this reaction increases with elevation of temperature of plating solution, the progress of Cannizzaro reaction can be suppressed by keeping the plating solution at a low temperature. JP-A-2000-144438 discloses a plating apparatus equipped with a plating-practicing chamber and a circulation tank for circulating the plating solution. In this apparatus, the Cannizzaro reaction can be suppressed by always keeping low the temperature of plating solution present in the circulation tank for storing the plating solution.

Further, in this document, it is also mentioned that methanol can be added to the plating solution in some cases for the purpose of preventing the deterioration of plating solution caused by the Cannizzaro reaction, even though it is not expressly mentioned there whether the Cannizzaro reaction is that of formaldehyde or that of glyoxylic acid.

However, it is mentioned there that the method of adding methanol does not suppress the Cannizzaro reaction itself but the effect of this method has a certain limitation. That is, in the practical use of electroless copper plating solution, no successful case of suppressing the Cannizzaro reaction by the use of methanol has ever been known.

In "Hyomen Gijutsu (Surface Technology)", Vol. 42, No. 9, Pages 913–917 (1991) and The 6th national convention Record of Purinto Kairo Jissou Gakkai (Japan Institute of Printed Circuit), Pages 101–102, there is mentioned that, in the electroless copper plating solutions using glyoxylic acid as a reducing agent, the Cannizzaro reaction can be suppressed by using KOH as a pH adjusting agent more effectively than by using NaOH as a pH adjusting agent. Further, these reports refer to the higher solubility of potassium oxalate as compared with that of sodium oxalate, too.

In the case of these reports, nevertheless, NaOH was still used for realizing an alkaline pH value (pH=12.5) at the time of preparing the plating bath. As its result, precipitation of sodium oxalate corresponding to the quantity of sodium ion introduced into the plating solution in the initial stage was unavoidable in the case of these reports.

In the case of using glyoxylic acid as a reducing agent for the electroless copper plating solution, there have so far been problems that the reacting quantity of Cannizzaro reaction is larger, the plating solution is less stable, and the cost is higher than in the case of using formaldehyde as the reducing agent.

As to the stability of plating solution, it can be considered that a high reacting quantity of Cannizzaro reaction results in an elevation of salt concentration in the plating solution, which brings about a reduction of dissolved oxygen concentration in the plating solution and thereby an instability of plating solution.

Further, in the case of using glyoxylic acid, the progress of Cannizzaro reaction or the plating reaction brings about accumulation of oxalic acid, namely the oxidized product of glyoxylic acid, in the plating solution. In the prior electroless copper plating process, it has been conventional to carry out the plating process while adding NaOH to keep the plating solution alkaline. Thus, there has been a problem that, since sodium oxalate is low in solubility, the crystal of sodium oxalate precipitates in the plating solution and deposited on some area of base board, where no plating layer can be deposited and a void is formed.

With the aim of avoiding the rise in the salt concentration in the plating solution and the formation of precipitate of sodium oxalate, a method of adding KOH as a pH adjusting agent for keeping pH value alkaline during the plating treatment has been studied.

The description of "Hyomen Gijutsu (Surface Technology)", Vol. 42, No. 9, Pages 913–917 (1991) shows, however, that such a method of using KOH gave so low a Cannizzaro reaction-suppressing effect as 15–40%, as compared with the case of using NaOH. Although the suppressing effect was 40% as compared with NaOH when one hour had passed after start of the plating, the suppressing effect dropped to 15% when 5 hours had passed after start of plating ("Hyomen Gijutsu (Surface Technology)", Vol. 42, No. 9, Page 915, line 16 of the main text). Since electroless copper plating solution is usually used for a long period of time, the tendency of decreasing the suppressing effect with time is a fatal disadvantage.

Further, as is mentioned in "Hyomen Gijutsu (Surface technology)", Vol. 42, No. 9, Page 913–917 (1991) and JP-A-61-183474, potassium oxalate is higher than sodium oxalate in solubility and hence the use of KOH as a pH adjusting agent is considered advantageous from the viewpoint of preventing the precipitation of oxalate.

However, since a plating solution contains other salts such as complexing agent, additives, counter anion of copper ion, etc. in large amounts, the precipitate of potassium oxalate can be formed at a concentration lower than its saturation solubility in pure water.

Further, in "Hyomen Gijutsu (Surface Technology)", Vol. 42, No. 9, Page 913–917 (1991), paragraph of experimental method and in Table 1 of "The 6th national convention Record of Purinto Kairo Jissou Gakkai (Japan Institute of Printed Circuit)", Pages 101–102, there is mentioned that NaOH was used for the purpose of making the pH value of plating solution alkaline (pH=12.5) at the time of preparing the plating bath, so that precipitation of sodium oxalate, in an amount corresponding to the sodium ion concentration present in the plating solution, unavoidably took place in the initial stage of preparing the plating solution, which caused various problems such as formation of plating void, etc.

In Examples 22, 24, 25 and 30 of JP-A-61-183474, there is mentioned an electroless copper plating solution containing glyoxylic acid as a reducing agent and no substantial quantity of sodium. Such plating solutions are considered improved in stability and longer in lifetime as compared with plating solutions having a similar formulation. This is attributable to that potassium oxalate is higher than sodium oxalate in solubility and that the period of time having passed from the start of plating to the first occurrence of floatation and precipitation of oxalate in the plating solution is longer.

However, there is a problem that although the solubility of potassium oxalate is really higher than that of sodium oxalate, solubility of potassium oxalate is far lower than that of formate which is an oxidized product formed from formaldehyde, so that the lifetime of plating solution, namely the period of time having passed from the start of plating process to the first floatation and precipitation of potassium oxalate in the plating solution, is shorter than that in the case of using formaldehyde.

Even in the case of an electroless copper plating solution containing no substantial quantity of sodium, the lifetime as a plating solution is so short as a half or less as compared with the lifetime of general electroless copper plating solutions using formaldehyde as a reducing agent.

Such a short lifetime of plating solution brings about various demerits such as an increased cost of materials used for plating solution, an increased payroll needed for refreshing the plating solution, and an increased quantity of waste due to the short lifetime of plating solution.

In conclusion, in the prior electroless copper plating solution using KOH as a pH adjusting agent, the Cannizzaro reaction-suppressing effect drops to only 15% five hours after start of plating process, and such a low suppressing effect is insufficient for an electroless copper plating solution which must be used over a long period of several tens to several thousands hours.

On the other hand, the method of stabilizing a plating solution by addition of methanol only is not suitable because this method does not suppress the Cannizzaro reaction itself, and one of the factors determining the lifetime of electroless copper plating solutions using glyoxylic acid as a reducing agent is the accumulation of oxalic acid due to Cannizzaro reaction.

For the above-mentioned reasons, the technique of electroless copper plating using glyoxylic acid as a reducing agent has not been adopted extensively as an industrial process.

It is an object of this invention to provide an electroless copper plating solution using glyoxylic acid as a reducing agent which is small in the reacting quantity of Cannizzaro reaction, does not largely cause the precipitation of the salt accumulated in the electroless copper plating solution due to the plating reaction and Cannizzaro reaction, and is stably usable over a long period of time.

It is another object of this invention to provide an electroless copper plating process which makes it possible to carry out plating in a high stability for a long period of time by the use of an electroless copper plating solution using glyoxylic acid as a reducing agent.

It is yet another object of this invention to provide a process for producing a circuit board which can be plated with an electroless copper plating solution using glyoxylic acid as a reducing agent to form a plating film keeping stable over a long period of time.

In order to solve the problems mentioned above, this invention provides an electroless copper plating solution comprising copper ion, a complexing agent for copper ion, a reducing agent for copper ion and a pH adjusting agent, wherein said reducing agent for copper ion is glyoxylic acid or a salt thereof, said pH adjusting agent is potassium hydroxide, and said electroless copper plating solution contains at least one member selected from the group consisting of metasilicic acid, a salt of metasilicic acid, germanium dioxide, a salt of germanic acid, phosphoric acid, a salt of phosphoric acid, vanadic acid, a salt of vanadic acid, stannic acid and a salt of stannic acid in an amount of 0.0001 mol/L or more.

Further, in order to achieve the object mentioned above, this invention provides an electroless copper plating solution comprising copper ion, a complexing agent for copper ion, a reducing agent for copper ion and a pH adjusting agent, wherein said reducing agent for copper ion is glyxoylic acid or a salt thereof, said pH adjusting agent is potassium hydroxide, and said electroless copper plating solution contains at least one member selected from the group consisting of a primary amine, a secondary amine and methanol in an amount of 0.001 mol/L or more.

If desired, said electroless copper plating solution may additionally contain at least one member selected from the group consisting of 2,2'-bipyridyl, 1,10-phenanthroline, 2,9-dimethyl-1,10-phenanthroline, polyethylene glycol and polypropylene glycol.

In any one of the electroless copper plating solutions mentioned above, the quantities of each of sodium ion, iron ion, nitrate ion and nitrite ion can be 10 mg/L or less.

In order to achieve the above-mentioned another object of this invention, this invention further provides an electroless copper plating process using any one of the electroless copper plating solutions mentioned above which comprises continuously circulating and filtering the plating solution after a preparation of a plating bath but prior to a plating treatment of a body to be plated.

The period of time T required for continuously circulating and filtering the plating solution after a preparation of plating bath but prior to a plating treatment of a body to be plated preferably satisfies the following formula:

$$Y \cdot T > 3V$$

wherein V denotes a quantity of the plating solution and Y denotes a quantity of circulation per unit time.

In order to achieve the above-mentioned yet another object of this invention, this invention provides a process for producing a circuit board using any one of the above-mentioned electroless copper plating solutions which comprises continuously circulating and filtering the plating solution after a preparation of a plating bath but prior to a plating treatment of a base board.

In this case, too, the period of time T required for continuously circulating and filtering the plating solution after a preparation of plating bath but prior to a plating treatment of a body to be plates preferably satisfies the following formula:

$$Y \cdot T > 3V$$

wherein V denotes a quantity of the plating solution and Y denotes a quantity of circulation per unit time.

In order to achieve the above-mentioned yet another object of this invention, this invention provides a process for producing a circuit board which comprises forming a copper film by the use of any one of the above-mentioned electroless copper plating solutions and thereafter electroplating by using said copper film as a seed film for electro plating.

Other objects, features and advantages of the invention will become apparent from the following description of the embodiments of the invention.

DETAILED DESCRIPTION OF THE INVENTION

As used in this specification, the terms "phosphoric acid" and "salt of phosphoric acid" generically mean, respectively, a series of acids $P_2O_5.nH_2O$ formed upon hydrating phosphorus pentaoxide $P_2O_5$ to various extents and salts of said acids. Examples of said acids and salts include various ones such as ortho-phosphoric acid and salts thereof, metaphosphoric acid and salts thereof, isopolyphosphoric acid and salts thereof, diphosphoric acid (pyrophosphoric acid) and salts thereof, etc. The salts of phosphoric acid include various forms of ones such as tripotassium phosphate ($K_3PO_4$), dipotassium hydrogen phosphate ($K_2HPO_4$), etc. Vanadic acid, metasilicic acid and stannic acid are also generic names which should be interpreted in the same manner as phosphoric acid. Details of the definition are as described in, for instance, "Iwanami Rikagaku Jiten", published by Iwanami Shoten, or the like.

Next, an electroless copper plating solution comprising copper ion, a complexing agent for copper ion, a reducing agent for copper ion and a pH adjusting agent wherein said reducing agent for copper ion is glyoxylic acid or a salt thereof and said pH adjusting agent is potassium hydroxide will be mentioned.

The electroless copper plating reaction is usually considered to be expressed by the following reaction scheme:

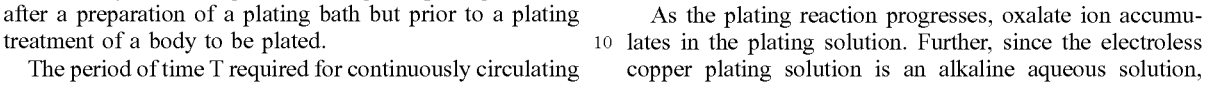

$$Cu^{2+}(EDTA)^{4-}+2CHOCOO^{-}+4OH^{-} \rightarrow Cu+2(COO)_2^{2-}+2H_2O+H_2+EDTA^{4-}$$

As the plating reaction progresses, oxalate ion accumulates in the plating solution. Further, since the electroless copper plating solution is an alkaline aqueous solution, Cannizzaro reaction expressed by the following reaction scheme progresses in the solution to accumulate oxalate ion and glycolate ion:

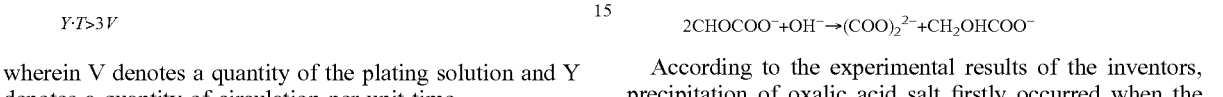

$$2CHOCOO^{-}+OH^{-} \rightarrow (COO)_2^{2-}+CH_2OHCOO^{-}$$

According to the experimental results of the inventors, precipitation of oxalic acid salt firstly occurred when the concentration of oxalic acid reached about 0.6 mol/L. In such a state, the plating solution became unstable, deposition of copper onto the surfaces other than the surface of the body to be plated, such as the wall of plating tank, the inner wall of pipes through which the plating solution was circulated, etc., began, so that the plating solution became further unusable. Although the concentration of oxalic acid causing the first precipitation of oxalic acid salt or the concentration of oxalic acid at which the plating solution became unstable was dependent on the formulation of plating solution and conditions of plating, it was considered about 0.5–0.8 mol/L, roughly speaking.

In this specification, the point in time when a salt of oxalic acid has begun to precipitate or when the plating solution has become unstable is expressed by "lifetime of plating solution". Herein, we will define the lifetime of plating solution as the point in time when 0.6 mol/L of oxalate ion has accumulated. If it is hypothesized that no Cannizzaro reaction has took place and the glyoxylic acid has totally been consumed through the plating reaction, the quantity of copper deposited in the form of a plating film should be 0.3 mol/L per liter of plating solution. This is because the reaction scheme presented above indicates that the reaction equivalent of glyoxylic acid is 2 mol per mol of copper ion. This is a quantity corresponding to 100 μm when the load of plating bath is assumed to be 2 $dm^2$/L.

Actually, however, a Cannizzaro reaction progressed, and oxalic acid was formed by reactions other than the plating reaction, too, as a result of which the plating thickness reached only bout 30 μm. Further, there is a problem that the Cannizzaro reaction not only shortens the lifetime of plating solution but also elevates the cost of plating process.

Thus, the inventors have studied on the additives capable of suppressing the Cannizzaro reaction when added to a plating solution.

It should be distinctly recognized herein that oxalic acid is formed so far as glyoxylic acid is used, and the saturation solubility of oxalic acid salt in the plating solution is dependent on the formulation of plating solution. The quantity of oxalic acid salt is 0.5–0.8 mol/L, roughly speaking, and the plating solution of this invention to which a Cannizzaro reaction-suppressing agent has been added does not exhibit an effect of increasing the saturation solubility. It is an object of this invention to suppress the Cannizzaro reaction, to improve the efficiency of the use of glyoxylic acid on the plating reaction, and as its result to increase the quantity of the body to be plated, to be subjected to the plating treatment, per unit volume of plating solution.

The inventors have discovered that methanol, primary amines, secondary amines, metasilicic acid, salts of metasilicic acid, phosphoric acid, salts of phosphoric acid, germanium dioxide, vanadic acid, salts of vanadic acid, stannic acid and salts of stannic acid are effective as the additive to be added to plating solution in order to suppress the Cannizzaro reaction. It has been found that a Cannizzaro reaction-suppressing effect can be exhibited by adding these Cannizzaro reaction-suppressing additives to a plating solution in an amount of 0.001 mol/L or more in the cases of methanol, primary amines and secondary amines and 0.0001 mol/L or more in the cases of metasilicic acid, salts of metasilicic acid, phosphoric acid, salts of phosphoric acid, germanium dioxide, vanadic acid, salts of vanadic acid, stannic acid and salts of stannic acid.

As used herein, the term "primary amine" means methylamine, ethylamine, propylamine, isopropylamine, benzylamine and the like. The term "secondary amine" means dimethylamine, diethylamine, methylethylamine and the like.

Although examples of the primary and secondary amines are not entirely shown herein, the Cannizzaro reaction-suppressing mechanism brought about by their addition is attributable to that their amine groups are electron-donative. That is to say, the amine groups are considered combined to the carbonyl carbon atom of glyoxylic acid through an addition reaction, in an alkaline aqueous solution. At this time, the amine group which has an electron-donating nature, shifts the carbonyl carbon atom of glyoxylic acid to the minus side.

The progress of Cannizzaro reaction is considered attributable to that the carbonyl carbon atom of glyoxylic acid is electron-attractive and positively charged. When an amine group is added thereto, the electron-attractive property of the carbonyl carbon atom of glyoxylic acid is relaxed and the Cannizzaro reaction is suppressed.

Accordingly, it can be said in principle that those compounds which can be added to the carbonyl carbon atom of glyoxylic acid and can exhibit an electron-donative character have a Cannizzaro reaction-suppressing effect.

However, tertiary amines show no Cannizzaro reaction-suppressing effect because they cannot be added to the carbonyl carbon atom of glyoxylic acid.

A mere addition of these additives to the conventional plating solutions is enough for the present purpose. As an instance, a case of using the conventional plating solution shown below will be considered herein, provided that concentration of potassium hydroxide is controlled so as to give a pH value of 12.4.

| [Formulation of prior art plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| 2,2'-Bipyridyl | 0.0002 mol/L |
| Polyethylene glycol (average molecular weight 600) | 0.03 mol/L |
| [Prior art plating conditions] | |
| pH | 12.4 |
| Liquid temperature | 70° C. |

In this invention, dimethylamine (for instance) is added in an amount of 0.02 mol/L to give the formulation of plating solution shown below, provided that concentration of potassium hydroxide is controlled so as to give a pH value of 12.4.

| [Formulation of plating solution of this invention] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| 2,2'-Bipyridyl | 0.0002 mol/L |
| Polyethylene glycol (average molecular weight 600) | 0.03 mol/L |
| Dimethylamine | 0.02 mol/L |
| [Plating conditions of this invention] | |
| pH | 12.4 |
| Liquid temperature | 70° C. |

As above, in this invention, dimethylamine is merely added to the prior formulation of plating solution. The addition of dimethylamine brings about no substantial changes in plating characteristics such as plating rate, properties of the formed plating film, etc. The reacting quantity of Cannizzaro reaction during the plating process is about 40% based on the prior plating process using no dimethylamine. That is to say, a Cannizzaro reaction-reducing effect amounting to 60% has been achieved by this invention. In the formulation of plating solution presented above, 2,2'-bipyridyl and polyethylene glycol are plating film property-improvers which are added for the purpose of improving the characteristic properties of plating film.

The Cannizzaro reaction-suppressing additive of this invention and the plating film property-improver mentioned above may be combined with each other arbitrarily. The inventors have confirmed that the following plating film property-improvers can give almost comparable plating rate and plating film properties to those achievable according to the prior art, when combined with the Cannizzaro reaction-suppressing additive of this invention: 2,2'-bipyridyl, 1,10-phenanthroline, 2,9-dimethyl-1,10-phenanthroline, metasilicic acid, salts of metasilicic acid, germanium dioxide, salts of germanic acid, phosphoric acid, salts of phosphoric acid, polyethylene glycol and polypropylene glycol. That is to say, when the above-mentioned plating film property improvers are combined with the Cannizzaro reaction-suppressing additive of this invention, only the Cannizzaro reaction can be suppressed without noticeably changing the plating rate and plating characteristics such as plating film property and the like, namely while keeping good these characteristics.

It has also been found that metasilicic acid, salts of metasilicic acid, germanium dioxide, salts of germanic acid, phosphoric acid, salts of phosphoric acid, vanadic acid, salts of vanadic acid, stannic acid and salts of stannic acid exhibit a Cannizzaro reaction-suppressing effect and a plating film property-improving effect simultaneously when used in combination with glyoxylic acid as a reducing agent and potassium hydroxide as a pH adjusting agent.

On the other hand, there are a number of film property-improvers which exhibit no noticeable improvement in film properties when used in combination with the Cannizzaro reaction-suppressing additives of this invention. Examples thereof are thiourea, potassium ferricyanide, thiophene and benotriazole. When these film property improvers are added to a plating solution in combination with the Cannizzaro reaction-suppressing additive of this invention, the plating rate becomes quite low and the plating film becomes small in ductility and inferior in reliability.

At the time of using the above-mentioned Cannizzaro reaction-suppressing agent, it is preferable that the plating solution contains only a small quantity of sodium ion. The lifetime of plating solution shows a maximum value at a sodium ion concentration of 10 mg/L or less. This is due to the low solubility of sodium oxalate. In the above-mentioned "formulation of plating solution of this invention", no sodium salt is used at all and deionized water is used for preparation of the plating solution, which is for the purpose of making the sodium ion concentration 10 mg/L or less.

As impurities other than sodium ion present in the plating solution, salts of nitric acid (nitrate ion), salts of nitrous acid (nitrite ion) and iron salts (iron ion) can be referred to, and these substances exercise an adverse influence on the plating characteristics. Nitrate ion and nitrite ion not only deteriorate the quality of plating film but also increase the reacting quantity of side reaction of glyoxylic acid in a plating solution in which the main reaction is Cannizzaro reaction. The increase in the side reaction of glyoxylic acid is undesirable, because it brings about an increase in the consumption of glyoxylic acid and thereby caused elevation of the cost of plating solution, an increase in the formation of oxalate ion and thereby caused shortening of lifetime of plating solution and an thereby caused increase in the quantity of waste.

In order to avoid these disadvantages, it is desirable to make the contents of nitrate ion and nitrite ion in the plating solution 10 mg/L or less. By making the contents of nitrate ion and nitrite ion in the plating solution 10 mg/L or less, there can be achieved not only an effect of improving the quality of plating film but also effects of prolonging the lifetime of plating solution and decreasing the quantity of waste.

Contamination by iron ion makes short the period of time necessary for starting the deposition of copper onto areas other than the body to be plated, as a result of which contamination of iron ion comes to shorten the lifetime of plating solution.

In the plating process using the above-mentioned plating solution, it is quite effective to subject the plating solution to preliminary circulation and filtration prior to the plating treatment of the body to be plated from the viewpoint of obtaining a plating film of good quality. This effect is due to removal of various impurities exercising negative influences on the plating characteristics such as quality of plating film, plating rate, etc.

One of the impurities is the dust entering from the environment. However, the impurity characteristic of this invention is the solid floats generated in the plating solution, and especially the solid floats generated just after preparation of plating bath. As impurities exercising adverse influences on the quality of plating film and plating characteristics, ions of metals such as calcium, barium, chromium, zinc manganese and the like can be referred to, in addition to the above-mentioned sodium, iron and nitrate.

The oxidized product of glyoxylic acid used as a reducing agent in the plating solution of this invention is oxalic acid, and the salts formed between oxalic acid and the above-mentioned metallic ions are quite low in solubility. If a plating bath not sufficiently circulated and filtered just after preparation of plating bath is used for a plating treatment of a body to be plated, the plating film is contaminated by the impurity metals, so that the resulting plating film is brittle and inferior in properties. There can be considered two modes of contamination of the impurity metals; one of them is an electrochemical reduction followed by deposition, and the other is formation of a sparingly soluble salt between the impurities and an anion generated in the plating solution, such as oxalate anion or the like, followed by precipitation and deposition.

If a plating solution is subjected to sufficient circulation and filtration prior to actual plating treatment of the body to be plated, the impurity metal ions which form a sparingly soluble salt with the small quantity of oxalate ion formed in the plating solution through Cannizzaro reaction of glyoxylic acid can be removed. That is to say, prior to the plating process, impurity metal ions and the like which exercise adverse influences on the quality of plating film and plating characteristics are made into solid floats of oxalic acid salts, and they are removed from plating solution by circulating and filtering the plating solution. By removing the impurities, the quality of plating film and the plating characteristics obtained from the plating solution of initial stage just after preparation of plating bath can be improved. Further, by adding Cannizzaro reaction-suppressing additives to the plating solution, a good quality of plating film and good plating characteristics can be ensured over a long period of time.

The plating solution of this invention contains a Cannizzaro reaction-suppressing additive. Since it is smaller in the formation of oxalate ion as compared with prior plating solutions containing no Cannizzaro reaction-suppressing additive, the impurity metal ions forming a sparingly soluble salt with oxalate ion can sufficiently be removed. Further, in order to avoid the contamination with the above-mentioned impurity ions originated from the chemicals fed in the course of plating process, the plating treatment is carried out while circulating and filtering the plating solution. A circuit board which has been subjected to a plating treatment using a plating solution previously subjected to sufficient circulation and filtration prior to the plating treatment in the above-mentioned manner shows high reliability in the areas in which a circuit is formed from a plated metal, such as through-holes.

EXAMPLES

Next, the electroless copper plating solution, the electroless copper plating process and the process for producing a circuit board, according to this invention, will be explained by referring to Tables 1 to 4. The Comparative Examples illustrate examples of prior electroless copper plating solution and electroless copper plating process.

Tables 1–4 are subdivided and enlarged expression of one original table into four segments. Table 5 illustrates the way of connection of the four segments. Tables 1–4 should be read as one sheet of table after the connection.

Example 1

To a plating solution are added copper sulfate as a copper ion source, ethylenediaminetetraacetic acid as a complexing agent, glyoxylic acid as a copper-reducing agent, potassium hydroxide as a pH adjusting agent, and dimethylamine as a Cannizzaro reaction-suppressing agent.

Formulation of plating solution and the plating conditions are shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| [Plating conditions] | |
| pH | 12.4 |
| Liquid temperature | 70° C. |

Using the above-mentioned electroless copper plating solution, a pattern was formed on a test base board by the electroless copper plating process. Occurrence or no occurrence of abnormal deposition of copper was checked, based on which lifetime of plating solution and quality of plating film were evaluated. The quantity of oxalate ion and the quantity of glycolate ion in the used plating solution were determined, from which the reacting quantity of Cannizzaro reaction was determined. The test board was prepared in the following manner. Further, properties of the plating film were also evaluated at the same time.

[Method for Preparation of Test Board]

A both-sided circuit board was prepared according to the process mentioned below, in order to evaluate the reliability of through-hole interconnection. Through-holes having a diameter ϕ of 0.3 mm were formed by means of a drill on a both-sided copper laminated board prepared by laminating copper layer of 18 μm thickness on both sides of a glass-epoxy base board having a thickness of 1.6 mm. Smear formed at the time of drilling were removed with an alkaline aqueous solution of potassium permanganate according to the method well known to specialists in the art. Then, a catalyst was deposited onto inner wall of the through-holes in the conventional way, by the use of cleaner-conditioner (trade name: CLC-601), Predip (trade name: PD301), sensitizing agent (trade name: HS-202B) and adhesion-promoter (trade name: ADP-601), all manufactured by Hitachi Kasei Kogyo Sha.

The base board thus obtained was subjected to an electroless copper plating treatment with the plating solution of the present example (Example 1). Thickness of the electroless copper plating was 20 μm, in cases where the copper film formation for the through-hole connection was completed only by carrying out the procedure of electroless copper plating of the present example (Example 1), while thickness of the electroless copper plating was 0.3 μm in cases where the electroless copper plating treatment of the present example (Example 1) was succeeded by formation of copper film for through-hole connection by the method of electro copper plating. In cases where the electroless copper plating of the present invention (Example 1) was succeeded by electro copper plating, the film thickness of electroplated copper film was 20 μm.

After forming a copper film having a thickness of 20 μm by the electroless copper plating or electro copper plating, a photosensitive dry film type etching resist was formed on whole area of the base board, and the circuit pattern part was covered with the etching resist by the treatments of light-exposure and development. The circuit base board thus obtained was treated with a copper etching solution composed mainly of sulfuric acid and hydrogen peroxide to dissolve and remove the exposed copper film. The circuit thus formed was a wiring having a width of 100 μm, and there was obtained the so-called through-hole chain in which 500 through-holes were chain-wise connected.

The test base board thus obtained was dipped in a plating solution together with a stainless steel plate to carry out an electroless copper plating at a loading factor (a value expressing the area of plated portion per liter of plating solution) of 100 $cm^2$ (=1 $dm^2$)/L. The stainless steel plate had previously been dipped in 17% aqueous hydrochloric acid for 2 minutes and thereafter in the above-mentioned sensitizing solution for 10 minutes, and then washed with water and finally subjected to the above-mentioned adhesion-promoting treatment for 3 minutes, after which it was washed with water and put to use.

During the plating process, the plating solution was agitated by blowing air constantly. During the plating process, the following supplementary solutions were fed as occasion demanded, so as to keep constant the copper ion concentration, the concentration of glyoxylic acid (reducing agent for copper ion) and the pH value:

(1) Solution for Supplying Cooper Ion

| | |
|---|---|
| $CuSO_4.5H_2O$ | 200 g |
| water | An amount needed for making the solution 1 L |

(2) Solution for Supplying Glyoxylic Acid (Reducing Agent for Copper Ion)

40% solution of glyoxylic acid.

(3) pH Adjusting Agent

| | |
|---|---|
| KOH | 40 g |
| Water | An amount needed for making the solution 1 L |

The step of forming a plating film up to a thickness of 30 μm on the stainless steel plate and the pattern portion of the test base board was taken as one run of plating. Whenever one run of plating was completed, the plating film was peeled off from the stainless plate and cut into a size of 1.25 cm×10 cm, and the mechanical strength of the plating film was measured by means of usual tensile tester.

For measuring the reacting quantity of Cannizzaro reaction, the plating solution was sampled out, and the quantities of oxalic acid and glycolic acid present in the plating solution were determined by the method of ion chromatography. Oxalic acid is formed through the plating reaction and Cannizzaro reaction, while glycolic acid is formed through Cannizzaro reaction only. Accordingly, the quantity of glycolic acid in the plating solution corresponds to the reacting quantity of Cannizzaro reaction in the plating solution. Twice the molar quantity of the quantity of glycolic acid thus determined is equal to the quantity of glyoxylic acid consumed by the Cannizzaro reaction.

As for the lifetime, the period of time from the start of plating to the first deposition of copper onto the areas other than the body to be plated was taken as lifetime of the plating solution.

The plating solution used in the present example (Example 1) showed a plating deposition velocity of 11.4 μm/h. This means that the period of time necessary for forming a plating film having a thickness of 30 μm was about 2 hours and 40 minutes.

The deposition of copper onto the areas other than the plated base board began when the quantity of deposited copper reached 0.29 mol/L. This point of time was taken as lifetime of the plating solution. Further, measurement of the quantity of glycolic acid in the plating solution having reached the lifetime gave a result of 0.01 mol/L. Accordingly, the quantity of glyoxylic acid consumed by the Cannizzaro reaction was 0.02 mol/L.

The quantity of glyoxylic acid having reacted for the purpose of depositing 0.29 mol/L of copper was 0.58 mol/L, and the quantity of glyoxylic acid consumed by the Cannizzaro reaction was 0.02 mol/L. Accordingly, the proportion of glyoxylic acid consumed by the Cannizzaro reaction was about 3.3% based on the total quantity of glyoxylic acid.

As above, it has been found that, in the plating solution of this invention, the proportion of glyoxylic acid consumed by the Cannizzaro reaction is as small as about 3.3% and the quantity of copper which can be deposited within the lifetime per liter of plating solution is as large as 0.29 mol/L. Thus, the effect of the present example (Example 1), namely the effect that a Cannizzaro reaction-suppressing effect can be brought about by adding dimethylamine to the plating solution, has been confirmed.

Next, mechanical properties of the plating film obtained in the present example (Example 1) were measured. A tensile test revealed that elongation was 1–2% and tensile strength was 280 MPa. There may be two ideas about the method for applying an electroless copper plating solution to the formation of wiring in a circuit board such as printed circuit board or the like.

The first method is a method of depositing a thin film having a thickness of about 0.1–1 μm on the surface of an insulating resin and using the thin film as a seed film for the subsequent formation of wiring by electroplating. This method is generally called a "seeding electroless copper plating technique". According to this method, the electroplated film subsequently formed has a large thickness and hence properties of the underground electroless copper plating film exercises no great influence upon the reliability of circuit interconnection of the circuit board, in most cases.

The second method is a method of forming a plating film having a thickness of about 10–30 μm only by the electroless copper plating process, and using it as a circuit. This method is generally called "full build electroless copper plating technique". According to this method, the plating film obtained by the electroless copper plating process is directly used as a circuit, and a plating film exhibiting good plating film properties has to be used in order to secure a good reliability of circuit interconnection on the circuit board.

Since the plating film obtained in the present example (Example 1) is small in elongation, it is difficult to apply this film to the above-mentioned full build plating. However, this film is considered sufficiently usable in the seeding plating. Based on this consideration, a test base board (mentioned above) was prepared therefrom. Thus, a copper film having a thickness of 0.3 μm was prepared by the use of the electroless copper plating solution of the present example (Example 1), and thereafter a electroplating was carried out to form a copper film having a thickness of 20 μm.

Formulation of electro copper plating solution and the conditions of the plating were as follows:

| [Electro copper plating solution] | |
|---|---|
| Copper sulfate pentahydrate | 0.3 mol/L |
| Sulfuric acid | 1.9 mol/L |
| Chlorine ion | 60 mg/L |

-continued

| | |
|---|---|
| Additive (Sulcup AC-90; manufactured by Kamimura Kogyo Corp.) | 5 mL/L |
| [Conditions of plating] | |
| Temperature of plating solution | 25° C. |
| Cathodic current density | 30 mA/cm$^2$ |
| Agitation | Air stream agitation |

After forming a copper film under the above-mentioned plating conditions, a circuit was formed in the above-mentioned manner, and there was obtained a test base board for evaluating the reliability of through-hole interconnection. Reliability of through-hole interconnection of this base board was evaluated by a thermal shock test and solder heat-resistance test. Conditions of the tests were as mentioned below.

[Thermal Shock Test]

A test piece was kept at −65° C. for 120 minutes, then returned to room temperature and kept at this temperature for 5 minutes, then kept at +125° C. for 120 minutes, and then returned to room temperature and kept at this temperature for 5 minutes. This series of procedures was regarded as one cycle. Five hundreds through-holes were chain-wise connected on the test base board mentioned above to obtain a through-hole chain, and the number of cycles required for a 10% elevation of resistance, as compared with the initial resistance, was measured on the through-hole chain. The number of cycles thus measured was taken as lifetime in the thermal shock test.

[Solder Heat Resistance Test]

A test base board was dipped in fused solder at 280° C. for 10 seconds, and thereafter taken out of the solder. This was taken as one run of solder heat resistance test. After repeating the solder heat resistance test five times, the test base board was imbedded into an imbedding resin for observation of section (Epomix; manufactured by BUEHLER Corp.), the sectional part of through-holes was skived, and 30 through-hole sections were visually examined under a microscope. Prior to the examination, the section of test piece was planished, subjected to soft etching with an etching solution comprising sulfuric acid and hydrogen peroxide to remove the smear formed at the time of grinding, and then examined microscopically. When no crack was formed, the solder heat resistance was evaluated as good.

In a thermal shock test of a test base board prepared by forming a copper film of about 0.3 μm thickness with the electroless copper plating solution of the present example (Example 1) and thereafter forming a copper film of about 20 μm thickness with the above-mentioned electro copper plating solution, the percent elevation of electrical resistance was 10% when 155 cycles had been completed, demonstrating that the result of thermal shock test was good. After the solder heat resistance test, no formation of crack was noticeable.

Accordingly, the test base board prepared according to the present example (Example 1) is good in reliability of through-hole interconnection, and it has been found that the electroless copper plating solution of the present example (Example 1) has a sufficient function as an electroless copper plating solution for forming a seed film for electroplating. Thus, the effect of the present example (Example 1) has been confirmed.

The results mentioned above are summarized in Table 1 and Table 2, wherein the concentration of additive is that in the plating solution. The plating rate was calculated by estimating thickness of the plating film deposited on the base board from observation of the section of base board, and dividing the thickness by the plating time.

The Na concentration, Fe concentration, nitrate ion concentration and nitrite ion concentration are those in the plating solution, which were determined by taking a portion of plating solution just after preparation of plating bath and measuring these values by means of atomic absorption spectroscopy or ion chromatography.

The quantity of deposited copper at the lifetime was calculated by dividing, by the quantity of plating solution, the total quantity of deposited copper having deposited onto the body to be plated during the lifetime, namely by the point of time when deposition of copper on the areas other than the body to be plated was firstly observed.

The reacting quantity of Cannizzaro reaction is the quantity of glyoxylic acid consumed through the Cannizzaro reaction, which was considered equal to twice the molar quantity of glycolic acid in the plating solution determined by ion chromatography. This quantity was expressed in terms of the quantity per liter of plating solution.

The proportion of Cannizzaro reaction is obtained by dividing the quantity of glyoxylic acid consumed the by Cannizzaro reaction by total quantity of glyoxylic acid. Herein, this value was calculated according to the following equation, for convenience:

Proportion of Cannizzaro reaction=Reacting quantity of Cannizzaro reaction/(reacting quantity of Cannizzaro reaction+quantity of deposited copper at lifetime×2)

Full build thermal shock resistance is the number of cycles at the time when percent change of resistance has firstly exceeded 10% in the above-mentioned thermal shock test on the test base board which has been plated with the plating solution of each Example or Comparative Example.

The full build plating solder heat resistance test is a test for checking whether or not crack is formed when a test board plated with the plating solution of each Example or Comparative Example to the above-mentioned solder heat resistance test. When no crack formation is noticeable, the result was regarded as "good". When crack formation was noticeable, the result was regarded as "not good".

The seeding solder thermal shock test is a test of subjecting a test board, which had been plated upto a thickness of about 0.1–1.0 μm with the plating solution of each Example or Comparative Example and further plated by the above-mentioned electro copper plating, to the above-mentioned thermal shock test. The result is expressed in the term of number of cycles at the time when the percent change of resistance has firstly exceeded 10%.

The seeding solder heat resistance test is a test for checking whether crack is formed or not when a test board is plated upto a thickness of about 0.1–1.0 μm with the plating solution of each Example or Comparative Example, further plated by the above-mentioned copper electro plating, and then subjected to the above-mentioned solder heat resistance test. When no crack is noticeable, the result is regarded as "good". When crack is formed, the result is regarded as "not good".

The term "plating void" expresses the number of voids noticeable on the plating film, which is counted through examination of the surface of test board under microscope when seeding plating of each Example or Comparative Example has been completed. The area of the visual examination was 100 $cm^2$ (=1 $dm^2$) throughout the examples.

Example 2

In the present invention (Example 2), the test was carried out in the same manner as in Example 1, except that methylamine was used as a Cannizzaro reaction-suppressing agent.

Formulation of plating solution and conditions of plating were as shown below, provided that concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Methylamine | 0.06 mol/L |
| [Plating conditions] | |
| pH | 12.4 |
| Liquid temperature | 70° C. |

The results of test of the present example (Example 2) are shown in Table 1 and Table 2.

Thus, the effect of the present example (Example 2), namely the effect that, in the plating solution of this invention, the proportion of glyoxylic acid consumed by the Cannizzaro reaction is small and the Cannizzaro reaction can be suppressed by adding methylamine to the plating solution, has been confirmed.

Example 3

In the present example (Example 3), the test was carried out in the same manner as in Example 1, except that benzylamine was used as the Cannizzaro reaction-suppressing agent.

Formulation of plating solution and the conditions of plating were as shown below, provided that concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Benzylamine | 0.02 mol/L |
| [Plating conditions] | |
| pH | 12.4 |
| Liquid temperature | 70° C. |

The results of the test of the present example (Example 3) are shown in Table 1 and Table 2.

Thus, the effect of the present example (Example 3), namely the effect that, in the plating solution of this invention, the proportion of glyoxylic acid consumed by Cannizzaro reaction is small and the Cannizzaro reaction can be suppressed by adding benzylamine to the plating solution, has been confirmed.

Example 4

In the present example (Example 4), the test of Example 1 was repeated, except that benzylamine was used as the Cannizzaro reaction-suppressing agent in the same manner as in Example 3. The present example (Example 4) was different from Example 3 only in that the concentration of benzylamine was low in Example 4.

| [Formulation of plating solution] | |
|---|---|
| Copper sulfate pentahydrate | 0.04 mol/L |
| Ethylenediamine-tetraacetatic acid | 0.1 mol/L |
| Glyoxylic acid | 0.03 mol/L |
| Potassium hydroxide | 0.01 mol/L |
| Benzylamine | 0.001 mol/L |
| [Plating conditions] | |
| pH | 12.4 |
| Liquid temperature | 70° C. |

The results of test of the present example (Example 4) are shown in Table 1 and Table 2.

Thus, the effect of the present example (Example 4), namely the effect that, in the plating solution of this invention, the proportion of glyoxylic acid consumed by Cannizzaro reaction is small and the Cannizzaro reaction can be suppressed by adding benzylamine to the plating solution, has been confirmed.

Example 5

In the present example (Example 5), the test of Example 1 was repeated, except that hexamethylenediamine was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Hexamethylenediamine | 0.02 mol/L |
| [Plating conditions] | |
| pH | 12.4 |
| Liquid temperature | 70° C. |

The results of test of the present example (Example 5) were as shown in Table 1 and Table 2.

Thus, the effect of the present example (Example 5), namely the effect that, in the plating solution of this invention, the proportion of glyoxylic acid consumed by Cannizzaro reaction is small and the Cannizzaro reaction can be suppressed by adding hexamethylenediamine to the plating solution, has been confirmed.

Example 6

In the present example (Example 6), the test of Example 1 was repeated, except that diethylenetriamine was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Diethylenetriamine | 0.02 mol/L |
| [Plating conditions] | |
| pH | 12.4 |
| Liquid temperature | 70° C. |

The results of test of the present example (Example 6) were as shown in Table 1 and Table 2.

Thus, the effect of the present example (Example 6), namely the effect that, in the plating solution of this invention, the proportion of glyoxylic acid consumed by Cannizzaro reaction is small and the Cannizzaro reaction can be suppressed by adding diethylenetriamine to the plating solution, has been confirmed.

Example 7

In the present example (Example 7), the test of Example 1 was repeated, except that methanol was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Methanol | 1.0 mol/L |
| [Plating conditions] | |
| pH | 12.4 |
| Liquid temperature | 70° C. |

The results of test of the present example (Example 7) were as shown in Table 1 and Table 2.

Thus, the effect of the present example (Example 7), namely the effect that, in the plating solution of this invention, the proportion of glyoxylic acid consumed by Cannizzaro reaction is small and the Cannizzaro reaction can be suppressed by adding methanol to the plating solution, has been confirmed.

Example 8

In the present example (Example 8), the test of Example 1 was repeated, except that sodium metasilicate was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Sodium metasilicate | 0.003 mol/L |
| [Plating conditions] | |
| pH | 12.4 |
| Liquid temperature | 70° C. |

The results of test of the present example (Example 8) were as shown in Table 1 and Table 2.

The plating film obtained with the plating solution of the present example (Example 8) exhibited an elongation of 12.3% and a tensile strength of 315 MPa, which were both good values. Thus, a full build plating was carried out with the plating solution of the present example (Example 8) to prepare a test base board, and the reliability of through-hole interconnection was evaluated. The results of this evaluation are also shown in Tables 1 and 2.

Thus, the effect of the present example (Example 8), namely the effect that, in the plating solution of this invention, the proportion of glyoxylic acid consumed by Cannizzaro reaction is small and the Cannizzaro reaction can be suppressed by adding sodium metasilicate to the plating solution, has been confirmed.

Example 9

In the present example (Example 9), the test of Example 1 was repeated, except that phosphoric acid was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Phosphoric acid | 0.02 mol/L |
| [Plating conditions] | |
| pH | 12.4 |
| Liquid temperature | 70° C. |

The results of test of the present example (Example 9) were as shown in Table 1 and Table 2.

The plating film obtained with the plating solution of the present example (Example 9) exhibited an elongation of 5.3% and a tensile strength of 360 MPa, which were both good values. Thus, a full build plating was carried out with the plating solution of the present example (Example 9) to prepare a test board, and the reliability of through-hole interconnection was evaluated. The result of this evaluation is also shown in Tables 1 and 2.

Thus, the effect of the present example (Example 9), namely the effect that, in the plating solution of this invention, the proportion of glyoxylic acid consumed by Cannizzaro reaction is small and the Cannizzaro reaction can be suppressed by adding phosphoric acid to the plating solution, has been confirmed.

Example 10

In the present example (Example 10), the test of Example 1 was repeated, except that germanium dioxide was used as the Cannizzaro reaction-suppressing agent.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Germanium dioxide | 0.001 mol/L |
| [Plating conditions] | |
| pH | 12.4 |
| Liquid temperature | 70° C. |

The results of test of the present example (Example 10) were as shown in Table 1 and Table 2.

The plating film obtained with the plating solution of the present example (Example 10) exhibited an elongation of 11.8% and a tensile strength of 328 MPa, which were both good values. Thus, a full build plating was carried out with the plating solution of the present example (Example 10) to prepare a test board, and the reliability of through-hole interconnection was evaluated. The result of this evaluation is also shown in Tables 1 and 2.

Thus, the effect of the present example (Example 10), namely the effect that, in the plating solution of this invention, the proportion of glyoxylic acid consumed by Cannizzaro reaction is small and the Cannizzaro reaction can be suppressed by adding germanium dioxide to the plating solution, has been confirmed.

Example 11

In the present example (Example 11), the test of Example 1 was repeated, except that metavanadic acid ($HVO_3$) was used as the Cannizzaro reaction-suppressing agent. Example 11 was different from Example 3 only in that the temperature of plating solution was low.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Metavanadic acid | 0.0001 mol/L |
| [Plating conditions] | |
| pH | 12.4 |
| Liquid temperature | 70° C. |

The results of test of the present example (Example 11) were as shown in Table 1 and Table 2.

Thus, the effect of the present example (Example 11), namely the effect that, in the plating solution of this invention, the proportion of glyoxylic acid consumed by Cannizzaro reaction is small and the Cannizzaro reaction can be suppressed by adding metavanadic acid to the plating solution, has been confirmed.

Example 12

In the present example (Example 12), the test of Example 1 was repeated, except that potassium stannate ($K_2SnO_3$) was used as the Cannizzaro reaction-suppressing agent. Example 12 was different from Example 3 only in that the temperature of plating solution was low.

Formulation of plating solution and the plating conditions were as shown below, provided that concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Potassium stannate | 0.02 mol/L |
| [Plating conditions] | |
| pH | 12.4 |
| Liquid temperature | 70° C. |

The results of test of the present example (Example 12) were as shown in Table 1 and Table 2.

Thus, the effect of the present example (Example 12), namely the effect that, in the plating solution of this invention, the proportion of glyoxylic acid consumed by Cannizzaro reaction is small and the Cannizzaro reaction can be suppressed by adding potassium stannate to the plating solution, has been confirmed.

Example 13

In the present example (Example 13), the test of Example 1 was repeated, except that benzylamine was used as the Cannizzaro reaction-suppressing agent. Example 13 was different from Example 3 only in that the temperature of plating solution was low.

Formulation of plating solution and the plating conditions were as shown below, provided that concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Benzylamine | 0.02 mol/L |
| [Plating conditions] | |
| pH | 12.4 |
| Liquid temperature | 26° C. |

The results of test of the present example (Example 13) were as shown in Table 1 and Table 2.

Thus, the effect of the present example (Example 13), namely the effect that, in the plating solution of this invention, the proportion of glyoxylic acid consumed by Cannizzaro reaction is small and the Cannizzaro reaction can be suppressed by adding benzylamine to the plating solution, has been confirmed.

Example 14

In the present example (Example 14), the test of Example 1 was repeated, except that dimethylamine was used as the Cannizzaro reaction-suppressing agent. Example 14 was different from Example 1 only in that the dimethylamine was not used by adding itself alone to the plating solution but dimethylamine was added to an aqueous solution of glyoxylic acid and the resulting solution was added to the plating solution. Further, dimethylamine was added also to the supplementary aqueous solution of glyoxylic acid which was added to the plating solution for the purpose of keeping the concentration of glyoxylic acid in a desired range.

The formulation of plating solution, the conditions of plating and the formulation of the supplementary aqueous solution of glyoxylic acid were as shown below, provided that concentration of potassium hydroxide was controlled so as to give a pH value of 12.4.

| | |
|---|---|
| [Formulation of plating solution (at the time of preparing the plating bath)] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine (added simultaneously with glyoxylic acid) | 0.03 mol/L |
| [Plating conditions] | |
| pH | 12.4 |
| Liquid temperature | 70° C. |
| [Supplementary glyoxylic acid solution] | |
| Glyoxylic acid | 5.0 mol/L |
| Dimethylamine | 5.0 mol/L |

The results of test of the present example (Example 14) were as shown in Table 1 and Table 2.

Thus, the effect of the present example (Example 14), namely the effect that, in the plating solution of this invention, the proportion of glyoxylic acid consumed by Cannizzaro reaction is small and the Cannizzaro reaction can be suppressed by using the glyoxylic acid solution to which dimethylamine has previously been added and thereby adding dimethylamine to the plating solution, has been confirmed.

Example 15

In the present example (Example 15), the test of Example 1 was repeated, except that dimethylamine as a Cannizzaro reaction-suppressing agent and 2,2'-bipyridyl as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| 2,2'-Bipyridyl | 0.0002 mol/L |
| [Plating conditions] | |
| pH | 12.4 |
| Liquid temperature | 70° C. |

Results of the test of the present example (Example 15) were as shown in Table 1 and Table 2.

The plating film obtained with the plating solution of the present example (Example 15) exhibited an elongation of 18.3% and a tensile strength of 315 MPa, which were both good values. Thus, a full build plating was carried out by the use of the plating solution of the present example (Example 15) to prepare a test base board, and the reliability of through-hole interconnection was evaluated. The results of the evaluation are also shown in Tables 1 and 2.

Thus, the effect of the present example (Example 15), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 16

In the present example (Example 16), the test of Example 1 was repeated, except that benzylamine as a Cannizzaro reaction-suppressing agent and 2,2'-bipyridyl as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Benzylamine | 0.02 mol/L |
| 2,2'-Bipyridyl | 0.0002 mol/L |
| [Plating conditions] | |
| pH | 12.4 |
| Liquid temperature | 70° C. |

Results of the test of the present example (Example 16) were as shown in Table 1 and Table 2.

The plating film obtained with the plating solution of the present example (Example 16) exhibited an elongation of 13.8% and a tensile strength of 308 MPa, which were both good values. Thus, a full build plating was carried out by the use of the plating solution of the present example (Example 16) to prepare a test base board, and the reliability of through-hole interconnection was evaluated. The results of the evaluation are also shown in Tables 1 and 2.

Thus, the effect of the present example (Example 16), namely the effect that, in the plating solution of this invention, the proportion of glyoxylic acid consumed by the Cannizzaro reaction is small and the Cannizzaro reaction can be suppressed by adding benzylamine to the plating solution, and further the Cannizzaro reaction can be suppressed and a plating film excellent in mechanical property can be obtained by a combined use of a film property-improving additive, has been confirmed.

Example 17

In the present example (Example 17), the test of Example 1 was repeated, except that dimethylamine as a Cannizzaro reaction-suppressing agent and 1,10-phenanthroline as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| 1,10-Phenanthroline | 0.0005 mol/L |
| [Plating conditions] | |
| pH | 12.4 |
| Liquid temperature | 70° C. |

Results of the test of the present example (Example 17) were as shown in Table 1 and Table 2.

The plating film obtained with the plating solution of the present example (Example 17) exhibited an elongation of 13.9% and a tensile strength of 325 MPa, which were both good values. Thus, a full build plating was carried out by the use of the plating solution of the present example (Example 17) to prepare a test base board, and the reliability of through-hole interconnection was evaluated. The results of the evaluation are also shown in Tables 1 and 2.

Thus, the effect of the present example (Example 17), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 18

In the present example (Example 18), the test of Example 1 was repeated, except that dimethylamine as a Cannizzaro reaction-suppressing agent and 2,9-dimethyl-1,10-phenanthroline as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| 2,9-Dimethyl-1,10-phenanthroline | 0.0005 mol/L |
| [Plating conditions] | |
| pH | 12.4 |
| Liquid temperature | 70° C. |

Results of the test of the present example (Example 18) were as shown in Table 1 and Table 2.

The plating film obtained with the plating solution of the present example (Example 18) exhibited an elongation of 12.6% and a tensile strength of 333 MPa, which were both good values. Thus, a full build plating was carried out by the use of the plating solution of the present example (Example 18) to prepare a test base board, and the reliability of through-hole interconnection was evaluated. The results of the evaluation are also shown in Tables 1 and 2.

Thus, the effect of the present example (Example 18), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 19

In the present example (Example 19), the test of Example 1 was repeated, except that dimethylamine as a Cannizzaro reaction-suppressing agent and polyethylene glycol as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| Polyethylene glycol (average molecular weight: 1,000) | 0.001 mol/L |
| [Plating conditions] | |
| pH | 12.4 |
| Liquid temperature | 70° C. |

Results of the test of the present example (Example 19) were as shown in Table 1 and Table 2.

The plating film obtained with the plating solution of the present example (Example 19) exhibited an elongation of 8.6% and a tensile strength of 312 MPa, which were both good values. Thus, a full build plating was carried out by the use of the plating solution of the present example (Example 19) to prepare a test base board, and the reliability of through-hole interconnection was evaluated. The results of the evaluation are also shown in Tables 1 and 2.

Thus, the effect of the present example (Example 19), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 20

In the present example (Example 20), the test of Example 1 was repeated, except that dimethylamine as a Cannizzaro reaction-suppressing agent and polyethylene glycol as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| Polyethylene glycol (average molecular weight: 600) | 0.015 mol/L |
| [Plating conditions] | |
| pH | 12.4 |
| Liquid temperature | 70° C. |

Results of the test of the present example (Example 20) were as shown in Table 3 and Table 4.

The plating film obtained with the plating solution of the present example (Example 20) exhibited an elongation of 8.8% and a tensile strength of 322 MPa, which were both good values. Thus, a full build plating was carried out by the use of the plating solution of the present example (Example 20) to prepare a test base board, and the reliability of through-hole interconnection was evaluated. The results of the evaluation are also shown in Tables 3 and 4.

Thus, the effect of the present example (Example 20), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 21

In the present example (Example 21), the test of Example 1 was repeated, except that dimethylamine as a Cannizzaro reaction-suppressing agent and polypropylene glycol as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.02 mol/L |
| Polypropylene glycol (average molecular weight: 2,000) | 0.0005 mol/L |
| [Plating conditions] | |
| pH | 12.4 |
| Liquid temperature | 70° C. |

Results of the test of the present example (Example 21) were as shown in Table 3 and Table 4.

The plating film obtained with the plating solution of the present example (Example 21) exhibited an elongation of 6.2% and a tensile strength of 300 MPa, which were both good values. Thus, a full build plating was carried out by the use of the plating solution of the present example (Example 21) to prepare a test base board, and the reliability of through-hole interconnection was evaluated. The results of the evaluation are also shown in Tables 3 and 4.

Thus, the effect of the present example (Example 21), namely the effect that, in the plating solution of this invention, the proportion of glyoxylic acid consumed by the Cannizzaro reaction is small and the Cannizzaro reaction can be suppressed by adding dimethylamine to the plating solution, and further the Cannizzaro reaction can be suppressed and a plating film excellent in mechanical property can be obtained by a combined use of a film property-improving additive, has been confirmed.

Example 22

In the present example (Example 22), the test of Example 1 was repeated, except that dimethylamine as a Cannizzaro reaction-suppressing agent and polyethylene glycol as a film property-improving additive were added to the plating solution. Example 22 was different from Example 19 in that the plating temperature was low and a concentration of glyoxylic acid was high.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.3 mol/L |
| Potassium hydroxide | 0.01 mol/L |
| Dimethylamine | 0.02 mol/L |
| Polyethylene glycol (average molecular weight: 600) | 0.015 mol/L |
| [Plating conditions] | |
| pH | 12.4 |
| Liquid temperature | 26° C. |

Results of the test of the present example (Example 22) were as shown in Table 3 and Table 4 Evaluation of full build plating was not carried out, because the plating rate was low under the conditions adopted herein.

The effect of the present example (Example 22), namely the effect that, in the plating solution of this invention, the proportion of glyoxylic acid consumed by the Cannizzaro reaction is small and the Cannizzaro reaction can be suppressed by adding dimethylamine to the plating solution, has been confirmed.

Example 23

In the present example (Example 23), the test of Example 1 was repeated, except that sodium metasilicate as a Cannizzaro reaction-suppressing agent and 2,2'-bipyridyl as a film property-improving additive were added to the plating solution.

Formulation of plating solution and the plating conditions were as shown below, provided that concentration of potassium hydroxide was controlled so as to give a pH value of 12.4.

| [Formulation of plating solution] | |
|---|---|
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Sodium metasilicate | 0.0025 mol/L |
| 2,2'-Bipyridyl | 0.00025 mol/L |
| Polyethylene glycol (average molecular weight: 1,000) | 0.001 mol/L |
| [Plating conditions] | |
| pH | 12.4 |
| Liquid temperature | 70° C. |

Results of the test of the present example (Example 23) were as shown in Table 3 and Table 4.

The plating film obtained with the plating solution of the present example (Example 23) exhibited an elongation of 18.9% and a tensile strength of 325 MPa, which were both good values. Thus, a full build plating was carried out by the use of the plating solution of the present example (Example 23) to prepare a test base board, and the reliability of through-hole interconnection was evaluated. The results of the evaluation are also shown in Tables 3 and 4.

Thus, the effect of the present example (Example 23), namely the effect that, in the plating solution of this invention, the proportion of glyoxylic acid consumed by the Cannizzaro reaction is small and the Cannizzaro reaction can be suppressed by adding sodium metasilicate to the plating solution, and further the Cannizzaro reaction can be suppressed and a plating film excellent in mechanical property can be obtained by a combined use of a film property-improving additive, has been confirmed.

Examples 24–34

In Examples 24 to 34, the relation between the impurity present in the plating solution and the plating characteristic was studied. A case of using dimethylamine as a Cannizzaro reaction-suppressing agent and a case of using dimethylamine as a Cannizzaro reaction-suppressing agent and further adding 2,2'-bipyridyl as a film property-improving additive were studied.

Formulations of the plating solutions and the plating conditions in the two cases were as follows, provided that concentration of potassium hydroxide was throughout controlled so as to give a pH value of 12.4.

| | |
|---|---|
| [Formulation of plating solution (1)] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.005 mol/L |
| [Formulation of plating solution (2)] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| Dimethylamine | 0.01 mol/L |
| 2,2'-Bipyridyl | 0.0004 mol/L |
| [Plating conditions (the same throughout both the cases)] | |
| pH | 12.4 |
| Liquid temperature | 70° C. |

Table 3 and Table 4 illustrate the change in plating characteristic given by changing the concentration of impurity. The reacting quantity of Cannizzaro reaction is greatly dependent on impurity concentration, and the reacting quantity of Cannizzaro reaction increases when the concentration of sodium ion or nitrate ion (nitrite ion) reaches 10 mg/L or higher. It has also been found that contamination by iron ion brings about a short lifetime of plating solution.

Thus, the effect of Examples 24 to 34, namely the effect that the Cannizzaro reaction-suppressing effect of dimethylamine can be improved by keeping the concentration of any of sodium ion, iron ion, nitrate ion and nitrite ion which are impurities in the plating solution, in the range not exceeding 10 mg/L. It has also been found that the Cannizzaro reaction can be suppressed and a plating film excellent in mechanical property can be obtained by a combined use of a plating film property-improving additive.

Comparative Example 1

In the present example (Comparative Example 1), a case of adding no Cannizzaro reaction-suppressing agent to the plating solution is mentioned, provided that 2,2'-bipyridyl was added as a plating film property-improving additive.

Formulation of plating solution and the plating conditions were as shown below, provided that concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.03 mol/L |
| Potassium hydroxide | 0.01 mol/L |
| 2,2'-Bipyridyl | 0.0005 mol/L |
| [Plating conditions] | |
| pH | 12.4 |
| Liquid temperature | 70° C. |

The results of the test of the present example (Comparative Example 1) were as shown in Tables 3 and 4.

The quantity of copper which had been deposited during the lifetime of plating solution, namely by the time when the deposition of copper firstly took place in any area other than the body to be plated, was 0.1 mol/L. This quantity is smallest as compared with that in the other examples of this invention. On the other hand, the quantity of glyoxylic acid consumed by the Cannizzaro reaction was 0.41 mol/L, which was considerably greater as compared with that in the other examples of this invention.

Based on these results, it has been found that about 67.2% of glyoxylic acid supplied into the plating solution was consumed by the Cannizzaro reaction other than the plating reaction, and the efficiency of use of glyoxylic acid was much lower than that in the other examples of this invention.

Although an additive for improving the property of plating film was added, the results of thermal shock test and solder heat resistance test after full build plating were bad. This is considered attributable to occurrence of many voids in the resulting plating film.

In the case of seeding plating, too, the results of thermal shock test and solder heat resistance test were not good. As a result of detailed observation of cross section, it has been found that cracks were formed on the electroplated copper film formed by the full build plating on the voids present in the seeding plating film.

As a result, it has been found that, when the plating solution of this comparative example containing no Cannizzaro reaction-suppressing agent is applied to seeding plating, cracks starting from the voids present in the seeding plating film are formed in the resulting plating film to deteriorate the reliability.

Accordingly, it has been found that a plating solution containing no Cannizzaro reaction-suppressing agent is bad in the plating characteristics. Based on this fact, superiority of this invention has been ascertained.

Comparative Example 2

In the present example (Comparative Example 2), a case of adding no Cannizzaro reaction-suppressing agent to the plating solution is mentioned, provided that 2,2'-bipyridyl was added as an additive for improving the properties of plating film. The present example was different from Comparative Example 1 in that the temperature of plating solution was low and the concentration of glyoxylic acid was high.

Formulation of plating solution and the conditions of plating were as shown below, provided that the concentration of potassium hydroxide was controlled so as to give a pH value of 12.4.

| | |
|---|---|
| [Formulation of plating solution] | |
| Copper sulfate pentahydrate | 0.04 mol/L |
| Ethylenediamine-tetraacetic acid | 0.1 mol/L |
| Glyoxylic acid | 0.3 mol/L |
| Potassium hydroxide | 0.01 mol/L |
| 2,2'-Bipyridyl | 0.0005 mol/L |
| [Plating conditions] | |
| pH | 12.4 |
| Liquid temperature | 26° C. |

Results of the test of the present comparative example were as shown in Tables 3 and 4.

The quantity of copper deposited as a plating film during the lifetime of plating solution, namely by the time when deposition of copper had firstly occurred in any area other than the body to be plated, was 0.105 mol/L. This quantity is smaller than that in the other examples of this invention. On the other hand, the quantity of glyoxylic acid consumed by the Cannizzaro reaction was 0.41 mol/L, which was remarkably greater than that in the other examples of this invention.

Based on these results, it can be concluded that about 66.1% of the glyoxylic acid supplied to the plating solution was consumed by the Cannizzaro reaction other than the plating reaction, and the efficiency of use of glyoxylic acid was much lower than that in the other examples of this invention.

Further, when this plating solution was applied to a seeding plating, the results of thermal shock test and solder heat resistance test were bad. As a result of detailed observation of the cross section, it has been found that cracks were formed on the electroplated copper film prepared by full build plating on the voids present in the seeding plating film.

As its result, it has been found that, when the plating solution of the present comparative example containing no Cannizzaro reaction-suppressing agent is applied to seeding plating, cracks starting from the voids in the seeding plating are formed in the resulting plating film to deteriorate the reliability of plating film.

Accordingly, it has been found that a plating solution containing no Cannizzaro reaction-suppressing agent is bad in the plating characteristics. Based on this fact, superiority of this invention has been ascertained.

Example 35

In the present example, the plating process and the process for producing a circuit board, both according to this invention, will be mentioned.

This invention is characterized by sufficiently circulating and filtering the plating solution after preparation of the plating bath, until the time of feeding the base board to be plated. As the plating solution, the same one as that of Example 26 was used. That is to say, the plating solution contained 11 mg/L of iron ion. When this plating solution was directly used for plating, the quantity of deposited copper up to the time when the lifetime of plating solution was reached was 0.18 mol/L, as derived from Tables 3 and 4. In the present example (Example 35), the plating solution was circulated and filtered under the following conditions, prior to the feeding of the plating solution.

| [Conditions of filtration] | |
|---|---|
| Velocity of circulation | 100 L/minute |
| Filter for the filtration | Pole filter<br>manufactured by Japan Pole Corp.<br>(pore diameter 1 μm) |

Since the plating tank used in this test had a capacity of 100 L, the plating solution was thoroughly circulated in one minutes. Prior to the plating, circulation and filtration were carried out for 3 minutes. As its result, the quantity of copper deposited by the time of lifetime of plating solution was 0.26 mol/L, which was comparable to that in Example 22 where the concentration of iron ion was less than 10 mg/L. After the plating, the filter was taken out and washed with 20% hydrochloric acid plus 5% aqueous solution of hydrogen peroxide, and the washing was analyzed by atomic absorption spectroscopy. As a result, iron was detected. Based on the analytical results mentioned above, it was found that the iron ion had been filtered off.

Accordingly, the effect of the present example (Example 35), namely the effect that the lifetime of plating solution can be prolonged by sufficiently circulating and filtering the plating solution after preparation of the plating bath, prior to the feeding of the body to be plated and thereby removing the impurities from the plating solution, has been confirmed.

EFFECTS OF THE INVENTION

According to this invention, there can be obtained a plating solution which makes it possible to suppress the Cannizzaro reaction progressing in the electroless copper plating solution using glyoxylic acid as a reducing agent and exhibits good plating characteristic properties over a long period of time. Further, this invention makes it possible to produce a circuit board excellent in reliability.

(Explanation of the Tables)

Table 1 illustrates the formulations of plating solutions and plating conditions in Examples 1 to 19 of this invention.

Table 2 illustrates the results of plating, etc., in Examples 1 to 19 of this invention.

Table 3 illustrated the formulations of plating solutions and plating conditions in Examples 20 to 34 and Comparative Examples of this invention.

Table 4 illustrates the results of plating, etc., in Examples 20 to 34 and Comparative Examples of this invention.

Table 5 explains how to connect the Tables 1 to 4 to give one sheet of table.

It should be further understood by those skilled in the art that the foregoing description has been made on embodiments of the invention and that various changes and modifications may be made in the invention without departing from the spirit of the invention and the scope of the appended claims.

TABLE 1

| No. | Cannizzaro reaction-suppressing agent | Concentration (mol/L) | Film property-improving additive | Concentration (mol/L) | Plating temp. (° C.) | Plating rate (μm/h) | Na concentration (mg/L) | Fe concentration (mg/L) | Nitrate ion concentration (mg/L) | Nitrite ion concentration (mg/L) |
|---|---|---|---|---|---|---|---|---|---|---|
| Ex. 1 | Dimethylamine | 0.02 | — | — | 70 | 11.4 | — | — | — | — |
| Ex. 2 | Methylamine | 0.06 | — | — | 70 | 11.8 | — | — | — | — |
| Ex. 3 | Benzylamine | 0.02 | — | — | 70 | 11.3 | — | — | — | — |
| Ex. 4 | Benzylamine | 0.001 | — | — | 70 | 11.9 | — | — | — | — |
| Ex. 5 | Hexamethylenediamine | 0.02 | — | — | 70 | 11.3 | — | — | — | — |
| Ex. 6 | Diethylenetriamine | 0.02 | — | — | 70 | 11.2 | — | — | — | — |
| Ex. 7 | Methanol | 1.0 | — | — | 70 | 10.8 | — | — | — | — |
| Ex. 8 | Sodium metasilicate | 0.003 | — | — | 70 | 5.2 | 138 | — | — | — |
| Ex. 9 | Metaphosphoric acid | 0.02 | — | — | 70 | 6.3 | — | — | — | — |

TABLE 1-continued

| No. | Cannizzaro reaction-suppressing agent | Concentration (mol/L) | Film property-improving additive | Concentration (mol/L) | Plating temp. (° C.) | Plating rate (μm/h) | Na concentration (mg/L) | Fe concentration (mg/L) | Nitrate ion concentration (mg/L) | Nitrite ion concentration (mg/L) |
|---|---|---|---|---|---|---|---|---|---|---|
| Ex. 10 | Germanium dioxide | 0.001 | — | — | 70 | 5.1 | — | — | — | — |
| Ex. 11 | Metavanadic acid | 0.0001 | — | — | 70 | 5.4 | — | — | — | — |
| Ex. 12 | Potassium stannate | 0.02 | — | — | 70 | 5.5 | — | — | — | — |
| Ex. 13 | Benzylamine | 0.02 | — | — | 26 | 2.5 | — | — | — | — |
| Ex. 14 | Dimethylamine | 0.03 | — | — | 70 | 10.9 | — | — | — | — |
| Ex. 15 | Dimethylamine | 0.02 | 2,2'-Bipyridyl | 0.0002 | 70 | 3.8 | — | — | — | — |
| Ex. 16 | Benzylamine | 0.02 | 2,2'-Bipyridyl | 0.0002 | 70 | 3.6 | — | — | — | — |
| Ex. 17 | Dimethylamine | 0.02 | 1,10-Phenanthroline | 0.0005 | 70 | 4.8 | — | — | — | — |
| Ex. 18 | Dimethylamine | 0.02 | 2,9-Dimethyl-1,10-phenanthroline | 0.0005 | 70 | 3.6 | — | — | — | — |
| Ex. 19 | Dimethylamine | 0.02 | Polyethylene glycol (av. mol. wt. 1,000) | 0.001 | 70 | 6.7 | — | — | — | — |

(Ex.: Example)

TABLE 2

| No. | Quantity of copper deposited at lifetime (mol/L) | Reacting quantity of Cannizzaro reaction (mol/L) | Proportion of Cannizzaro reaction | Thermal shock test on full build plating (∽) | Solder heat resistance test on full build plating | Thermal shock test on seeding plating (∽) | Solder heat resistance test on seeding plating | Voids in plating (No./dm$^2$) |
|---|---|---|---|---|---|---|---|---|
| Ex. 1 | 0.290 | 0.020 | 3.33% | — | — | 155 | good | 0 |
| Ex. 2 | 0.285 | 0.025 | 4.20% | — | — | 160 | good | 0 |
| Ex. 3 | 0.290 | 0.026 | 4.29% | — | — | 150 | good | 0 |
| Ex. 4 | 0.270 | 0.028 | 4.93% | — | — | 155 | good | 0 |
| Ex. 5 | 0.280 | 0.026 | 4.44% | — | — | 160 | good | 0 |
| Ex. 6 | 0.250 | 0.029 | 5.48% | — | — | 150 | good | 0 |
| Ex. 7 | 0.260 | 0.026 | 4.76% | — | — | 160 | good | 0 |
| Ex. 8 | 0.130 | 0.015 | 5.45% | 165 | good | 160 | good | 3 |
| Ex. 9 | 0.255 | 0.027 | 5.03% | 145 | good | 155 | good | 0 |
| Ex. 10 | 0.220 | 0.028 | 5.98% | 165 | good | 160 | good | 0 |
| Ex. 11 | 0.250 | 0.029 | 4.95% | 145 | good | 155 | good | 0 |
| Ex. 12 | 0.250 | 0.026 | 4.88% | 145 | good | 155 | good | 0 |
| Ex. 13 | 0.260 | 0.026 | 4.76% | — | — | 165 | good | 0 |
| Ex. 14 | 0.290 | 0.020 | 3.33% | — | — | 155 | good | 0 |
| Ex. 15 | 0.260 | 0.028 | 5.11% | 175 | good | 160 | good | 0 |
| Ex. 16 | 0.250 | 0.029 | 5.48% | 170 | good | 160 | good | 0 |
| Ex. 17 | 0.260 | 0.028 | 5.11% | 150 | good | 150 | good | 0 |
| Ex. 18 | 0.255 | 0.028 | 5.20% | 145 | good | 150 | good | 0 |
| Ex. 19 | 0.280 | 0.027 | 4.60% | 140 | good | 155 | good | 0 |

(Ex.: Example)

TABLE 3

| No. | Cannizzaro reaction-suppressing agent | Concentration (mol/L) | Film property-improving additive | Concentration (mol/L) | Plating temp. (° C.) | Plating rate (μm/h) | Na concentration (mg/L) | Fe concentration (mg/L) | Nitrate ion concentration (mg/L) | Nitrite ion concentration (mg/L) |
|---|---|---|---|---|---|---|---|---|---|---|
| Ex. 20 | Dimethylamine | 0.02 | Polyethylene glycol (av. mol. wt. 600) | 0.015 | 70 | 8.5 | — | — | — | — |
| Ex. 21 | Dimethylamine | 0.02 | Polypropylene glycol (av. mol. wt. 2,000) | 0.0005 | 70 | 8.6 | — | — | — | — |
| Ex. 22 | Dimethylamine | 0.02 | Polyethylene glycol (av. mol. wt. 600) | 0.015 | 26 | 2.4 | — | — | — | — |
| Ex. 23 | Sodium metasilicate | 0.0025 | 2,2'-Bipyridyl<br>Polyethylene glycol (av. mol. wt. 1,000) | 0.0025<br>0.001 | 70 | 3.0 | 120 | — | — | — |
| Ex. 24 | Dimethylamine | 0.005 | — | — | 70 | 11.6 | <10 | <10 | <10 | <10 |
| Ex. 25 | Dimethylamine | 0.01 | 2,2'-Bipyridyl | 0.0004 | 70 | 2.8 | <10 | <10 | <10 | <10 |
| Ex. 26 | Dimethylamine | 0.005 | — | — | 70 | 11.2 | 11 | <10 | <10 | <10 |
| Ex. 27 | Dimethylamine | 0.01 | 2,2'-Bipyridyl | 0.0004 | 70 | 2.1 | <10 | 12 | <10 | <10 |
| Ex. 28 | Dimethylamine | 0.005 | — | — | 70 | 10.6 | <10 | 11 | <10 | <10 |
| Ex. 29 | Dimethylamine | 0.01 | 2,2'-Bipyridyl | 0.0004 | 70 | 3.1 | <10 | <10 | 11 | <10 |
| Ex. 30 | Dimethylamine | 0.005 | — | — | 70 | 11.6 | <10 | <10 | 15 | <10 |
| Ex. 31 | Dimethylamine | 0.01 | 2,2'-Bipyridyl | 0.0004 | 70 | 2.8 | <10 | <10 | <10 | 15 |

TABLE 3-continued

| No. | Cannizzaro reaction-suppressing agent | Concentration (mol/L) | Film property-improving additive | Concentration (mol/L) | Plating temp. (° C.) | Plating rate (μm/h) | Na concentration (mg/L) | Fe concentration (mg/L) | Nitrate ion concentration (mg/L) | Nitrite ion concentration (mg/L) |
|---|---|---|---|---|---|---|---|---|---|---|
| Ex. 32 | Dimethylamine | 0.01 | 2,2'-Bipyridyl | 0.0004 | 70 | 2.9 | 11 | <10 | <10 | 15 |
| Ex. 33 | Dimethylamine | 0.01 | 2,2'-Bipyridyl | 0.0004 | 70 | 3.0 | <10 | 11 | <10 | 15 |
| Ex. 34 | Dimethylamine | 0.01 | 2,2'-Bipyridyl | 0.0004 | 70 | 2.8 | 11 | 12 | 11 | <10 |
| Comp. Ex. 1 | — | — | 2,2'-Bipyridyl | 0.0005 | 70 | 2.9 | <10 | <10 | <10 | <10 |
| Comp. Ex. 2 | — | — | 2,2'-Bipyridyl | 0.0005 | 26 | 2.2 | <10 | <10 | <10 | <10 |

(Ex.: Example, Comp. Ex.: Comparative Example)

TABLE 4

| No. | Quantity of copper deposited at lifetime (mol/L) | Reacting quantity of Cannizzaro reaction (mol/L) | Proportion of Cannizzaro reaction | Thermal shock test on full build plating (∽) | Solder heat resistance test on full build plating | Thermal shock test on seeding plating (∽) | Solder heat resistance test on seeding plating | Voids in plating (No./dm$^2$) |
|---|---|---|---|---|---|---|---|---|
| Ex. 20 | 0.285 | 0.027 | 4.52% | 135 | Good | 155 | Good | 0 |
| Ex. 21 | 0.280 | 0.027 | 4.60% | 130 | Good | 155 | Good | 0 |
| Ex. 22 | 0.250 | 0.028 | 5.30% | — | — | 160 | Good | 0 |
| Ex. 23 | 0.135 | 0.019 | 6.57% | 180 | Good | 170 | Good | 3 |
| Ex. 24 | 0.270 | 0.029 | 5.10% | — | — | 155 | Good | 0 |
| Ex. 25 | 0.275 | 0.029 | 5.01% | 140 | Good | 150 | Good | 0 |
| Ex. 26 | 0.150 | 0.019 | 5.96% | — | — | 155 | Good | 12 |
| Ex. 27 | 0.135 | 0.011 | 3.91% | 25 | Not good | 120 | Good | 9 |
| Ex. 28 | 0.180 | 0.015 | 4.00% | — | — | 145 | Good | 12 |
| Ex. 29 | 0.200 | 0.125 | 23.81% | 25 | Not good | 135 | Good | 8 |
| Ex. 30 | 0.195 | 0.110 | 22.00% | — | — | 140 | Good | 8 |
| Ex. 31 | 0.195 | 0.150 | 27.78% | 20 | Not good | 130 | Good | 6 |
| Ex. 32 | 0.130 | 0.160 | 38.10% | 25 | Not good | 140 | Good | 14 |
| Ex. 33 | 0.150 | 0.150 | 33.33% | 15 | Not good | 130 | Good | 8 |
| Ex. 34 | 0.110 | 0.210 | 48.84% | 20 | Not good | 135 | Good | 15 |
| Comp. Ex. 1 | 0.100 | 0.41 | 67.21% | 5 | Not good | 10 | Not good | 124 |
| Comp. Ex. 2 | 0.105 | 0.41 | 66.13% | — | — | 15 | Not good | 230 |

(Ex.: Example, Comp. Ex.: Comparative Example)

TABLE 5

| | |
|---|---|
| Table 1<br>Table 3 | Table 2<br>Table 4 |

What is claimed is:

1. An electroless copper plating solution comprising copper ion, a complexing agent for copper ion, a reducing agent for copper ion and a pH adjusting agent, wherein said reducing agent for copper ion is glyoxylic acid or a salt thereof, said pH adjusting agent is potassium hydroxide, and said electroless copper plating solution contains at least one member selected from the group consisting of dimethylamine, benzylamine, diethylenetriamine, methylamine, and hexamethylenediamine in an amount of 0.001 mol/L or more.

2. The electroless copper plating solution according to claim 1, wherein said electroless copper plating solution further contains at least one member selected from the group consisting of 2,2'-bipyridyl, 1,10-phenanthroline, 2,9-dimethyl-1,10-phenanthroline, polyethylene glycol and polypropylene glycol.

3. The electroless copper plating solution according to claim 1, wherein said electroless copper plating solution further contains at least one of sodium ion, iron ion, nitrate ion and nitrite ion each in an amount of 10 mg/L or less.

* * * * *